US009957774B2

(12) United States Patent
Clark et al.

(10) Patent No.: US 9,957,774 B2
(45) Date of Patent: May 1, 2018

(54) PRESSURE STAGING FOR WELLHEAD STACK ASSEMBLY

(71) Applicant: HALLIBURTON ENERGY SERVICES, INC., Houston, TX (US)

(72) Inventors: Owen Ransom Clark, Dallas, TX (US); Joseph Michael Karigan, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 216 days.

(21) Appl. No.: 14/914,943

(22) PCT Filed: Dec. 16, 2013

(86) PCT No.: PCT/US2013/075239
§ 371 (c)(1),
(2) Date: Feb. 26, 2016

(87) PCT Pub. No.: WO2015/094146
PCT Pub. Date: Jun. 25, 2015

(65) Prior Publication Data

US 2017/0016303 A1 Jan. 19, 2017

(51) Int. Cl.
*E21B 33/08* (2006.01)
*E21B 33/06* (2006.01)

(52) U.S. Cl.
CPC ..... *E21B 33/085* (2013.01); *E21B 33/06* (2013.01)

(58) Field of Classification Search
CPC ..... E21B 33/03; E21B 33/06; E21B 33/08; E21B 33/085; E21B 33/068
USPC ..... 277/324, 326
See application file for complete search history.

(56) References Cited

U.S. PATENT DOCUMENTS

| | | | | |
|---|---|---|---|---|
| 1,813,402 | A * | 7/1931 | Hewitt | E21B 33/04 175/210 |
| 1,947,198 | A * | 2/1934 | Goble | E21B 33/08 184/105.3 |
| 3,840,072 | A | 10/1974 | Hutchison | |
| 4,634,095 | A | 1/1987 | Taylor et al. | |
| 4,647,076 | A | 3/1987 | Pollack et al. | |

(Continued)

FOREIGN PATENT DOCUMENTS

| | | |
|---|---|---|
| EP | 0595907 | 5/1994 |
| EP | 2053196 | 4/2009 |
| WO | 2012127180 | 9/2012 |

OTHER PUBLICATIONS

Halliburton , GeoBalance Managed Pressure Drilling from Halliburton (Youtube video), available online at https://www.youtube.com/watch?v=QnEEF6_XIPQ (website screenshot submitted), Oct. 27, 2011, 1 page.

(Continued)

*Primary Examiner* — Kenneth L Thompson
(74) *Attorney, Agent, or Firm* — Kilpatrick Townsend & Stockton LLP

(57) ABSTRACT

A wellhead stack assembly is provided that includes pressure restriction devices. The pressure restriction devices are staged such that each pressure restriction device is coupled to another pressure restriction device for cascading pressure differentials across the pressure restriction devices. Each pressure restriction device includes an active element positionable about a drill pipe for controlling a gap between the drill pipe and the active element.

17 Claims, 4 Drawing Sheets

(56) References Cited

U.S. PATENT DOCUMENTS

| | | | | |
|---|---|---|---|---|
| 5,588,491 | A | 12/1996 | Brugman et al. | |
| RE38,249 | E | 9/2003 | Tasson et al. | |
| 7,040,394 | B2 | 5/2006 | Bailey et al. | |
| 7,380,590 | B2 | 6/2008 | Hughes et al. | |
| 7,455,115 | B2 | 11/2008 | Loretz et al. | |
| 7,464,750 | B2 | 12/2008 | Schapel et al. | |
| 7,712,540 | B2 | 5/2010 | Loretz et al. | |
| 7,743,823 | B2 | 6/2010 | Hughes et al. | |
| 7,836,946 | B2 | 11/2010 | Bailey et al. | |
| 8,028,750 | B2 | 10/2011 | Hughes et al. | |
| 8,100,189 | B2 | 1/2012 | Edvardson et al. | |
| 8,322,432 | B2 | 12/2012 | Bailey et al. | |
| 8,985,229 | B2 * | 3/2015 | Edvardsen | E21B 33/08 166/127 |
| 2010/0230113 | A1 | 9/2010 | Hutin et al. | |
| 2011/0024195 | A1 | 2/2011 | Hoyer et al. | |
| 2011/0100710 | A1 | 5/2011 | Fossli | |
| 2011/0315404 | A1 | 12/2011 | Bailey et al. | |
| 2012/0067591 | A1 | 3/2012 | Couturier et al. | |
| 2012/0165997 | A1 | 6/2012 | Lewis et al. | |
| 2012/0292054 | A1 | 11/2012 | Orbell et al. | |
| 2012/0298370 | A1 | 11/2012 | Xu et al. | |
| 2012/0318496 | A1 | 12/2012 | Bailey et al. | |
| 2013/0118749 | A1 | 5/2013 | Hannegan et al. | |
| 2013/0192896 | A1 | 8/2013 | Bailey et al. | |

OTHER PUBLICATIONS

International Patent Application No. PCT/US2013/075239 , Chapter II Demand, filed Jan. 30, 2015, 13 pages.

International Patent Application No. PCT/US2013/075239 , International Search Report and Written Opinion, dated Sep. 23, 2014, 15 pages.

SIEM WIS , PCD, available online at http://www.siemwis.com/page/360/pdcd, at least as early as Aug. 20, 2013, 1 page.

* cited by examiner

PRESSURE STAGING FOR WELLHEAD STACK ASSEMBLY

CROSS-REFERENCE TO RELATED APPLICATIONS

This is a U.S. national phase under 35 U.S.C. § 371 of International Patent Application No. PCT/US2013/075239, titled "Pressure Staging for Wellhead Stack Assembly" and filed Dec. 16, 2013, the entirety of which is incorporated herein by reference.

TECHNICAL FIELD

The present disclosure relates generally to assemblies usable in connection with wellbore drilling.

BACKGROUND

A wellhead stack assembly can be mounted below a rig floor. A wellhead stack assembly includes pressure control devices, including but not limited to devices such as a rotating control device (RCD) and one or more blowout preventers, for sealing wellbore pressure from atmospheric pressure. Controlling and containing downhole pressures protects workers and equipment on the rig floor from wellbore pressure during a drilling operation. These devices can include seal elements that can wear from contact with a drill pipe and fluid from the wellbore.

DETAILED DESCRIPTION

Figure 1:
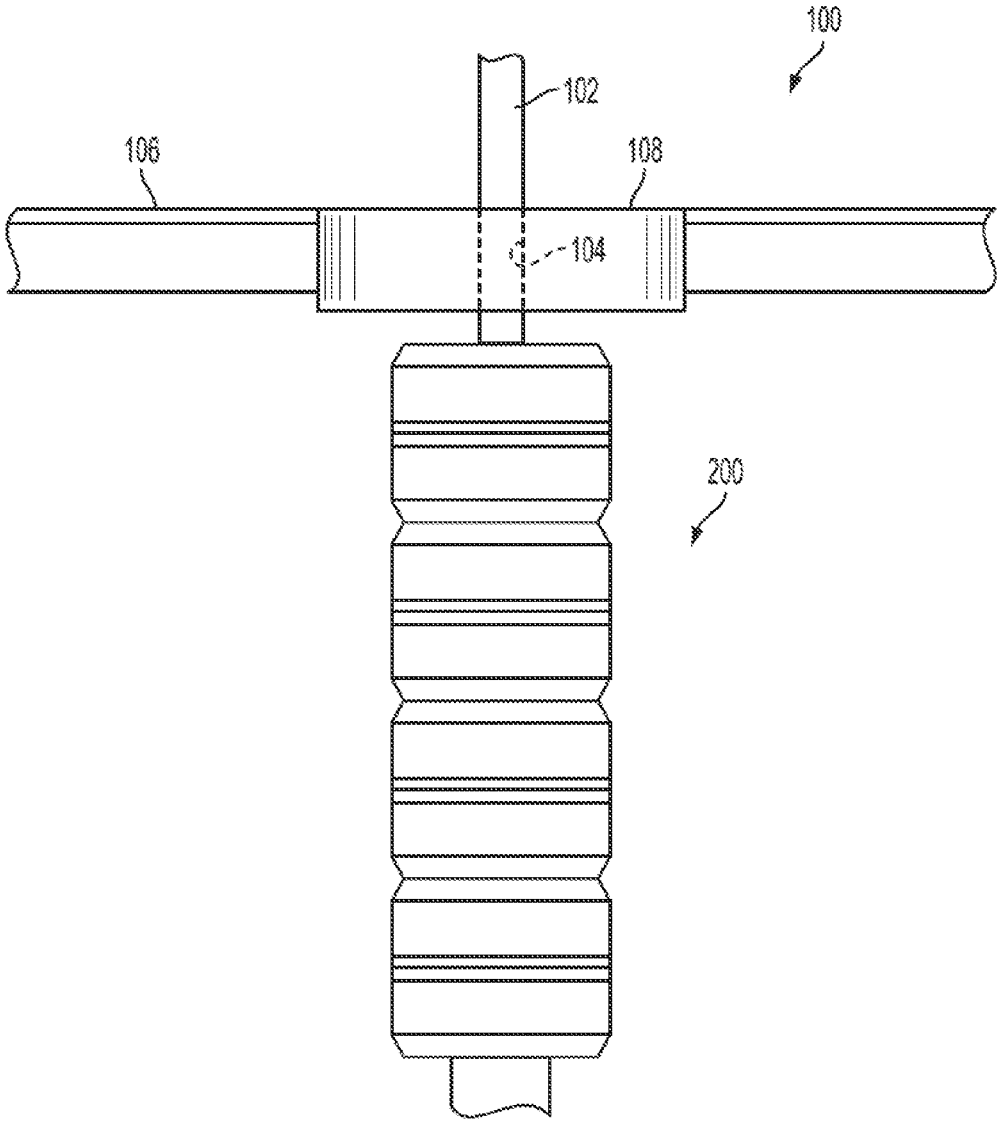
FIG. 1 is an elevation view of a wellhead stack system with staged pressure restriction devices according to one embodiment.

Certain aspects and features of the present disclosure relate to reducing a differential pressure across a given seal element of a pressure restriction device by arranging multiple seal elements of multiple pressure restriction devices of an assembly in a staged manner such that a cascade of pressures is applied to the seal elements. Examples of a pressure restriction device include a rotating control device (RCD), an annular blowout preventer (BOP), or another component of a wellhead stack assembly. The cumulative effect of staging the seal elements of the pressure restriction device may allow a large differential pressure to be held across the assembly and a lower differential pressure held across each individual seal element.

Multiple pressure restriction devices can be staged to close a wellbore annulus. The differential across each seal element of the devices can be controlled by the annular area around the drill pipe between the seal element and the drill pipe. Small gaps between the drill pipe and the seal elements can create a restriction and a pressure drop across each. This restriction can be adjustable to change the pressure drop based on flow rate and fluid properties. Each gap can be sized such that the seal element does not contact the drill pipe and the life of the seal element is extended by reducing or removing wear from mechanical action against the drill pipe. In some embodiments, control pressure provided to the active seal element can be controlled to adjust the amount of restriction.

Pressure restriction devices, such as RCDs and BOPs, can be used as part of a system to perform underbalanced and managed pressure drilling. For example, an RCD can divert drilling fluid returns from the well to separators, chokes, and other types of equipment in the system rather than through a flow nipple to the rig floor, as in overbalanced drilling. The RCD can be mounted above the BOP and below the rig floor, and the RCD can be installed above a drilling annular or in a riser on floating drilling units above or below a tension ring. The RCD can seal the annulus between the drill pipe and the inside walls of the stack using seal elements coupled to a rotating bearing assembly. A seal element can be an elastomeric (e.g., rubber nitrile, polyurethane, etc.) part that has an inner diameter sized to seal around a drill pipe and a cage that can provide structural support and couple to the bearing assembly.

A seal element may seal around a drill pipe and rotate with the drill pipe in relation to the stationary bearing assembly and body of the RCD or other pressure restriction device. As the seal element rotates relative to the stationary bearing assembly and body, the seal element can separate fluid from a wellbore from the atmosphere. The wellbore fluid can have abrasive and corrosive properties that can adversely affect the performance and life of the seal element. In addition, the mechanical action of stripping drill pipe through the seal element and the rotational torque transmitted through the seal element can cause the seal element to wear. A short wear life of a seal element can mean frequent maintenance to replace or condition the seal element and increased non-productive time for the drilling operation.

Staged seal elements, according to some embodiments, can increase the wear life of each seal element. Staged seal elements in which each seal element is coupled to a separate bearing assembly may also reduce the differential pressure across each seal element. A reduced pressure differential across a seal element can result in less wear on the seal elements and an increase in life. A reduced pressure differential can also result in less pressure load and lower demands on the bearings. A reduced pressure differential may also allow for the RCD or other type of pressure restriction device to be made from materials having thinner walls and lower required material strengths such that the RCD or other type of pressure restriction device may be smaller and slimmer than previously was achievable.

In some embodiments, use of staged seal elements in an RCD or a BOP of a stack assembly can allow chokes to be relocated or eliminated from the stack assembly. The chokes can be used to provide backpressure by restricting flow out of the assembly (i.e., metering out). The pressure staging across an RCD or a BOP can control backpressure and reduce the uppermost pressure to a point low enough to flow directly into separators without the need for separate chokes to hold backpressure. A system that can include staged seal elements may hold a higher amount of pressure than is possible by one seal element alone.

Devices with staged seal elements can be used as various types of equipment in a range of drilling techniques to reduce the differential pressure across each piece of equipment to increase life and reliability and lower the demands placed on each piece of equipment.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts by elevation view a wellhead stack system 100 according to one embodiment. The wellhead stack system 100 includes a wellhead stack assembly 200 with staged pressure restriction devices. A tubular string 102 extends through an opening 104 in a rig floor 106, and through the wellhead stack assembly 200. Examples of the tubular string include a drill string, a work string, a test string, and a completion string. The tubular string 102 can be rotated using a rotary table 108 or other suitable mechanism.

Figure 2:
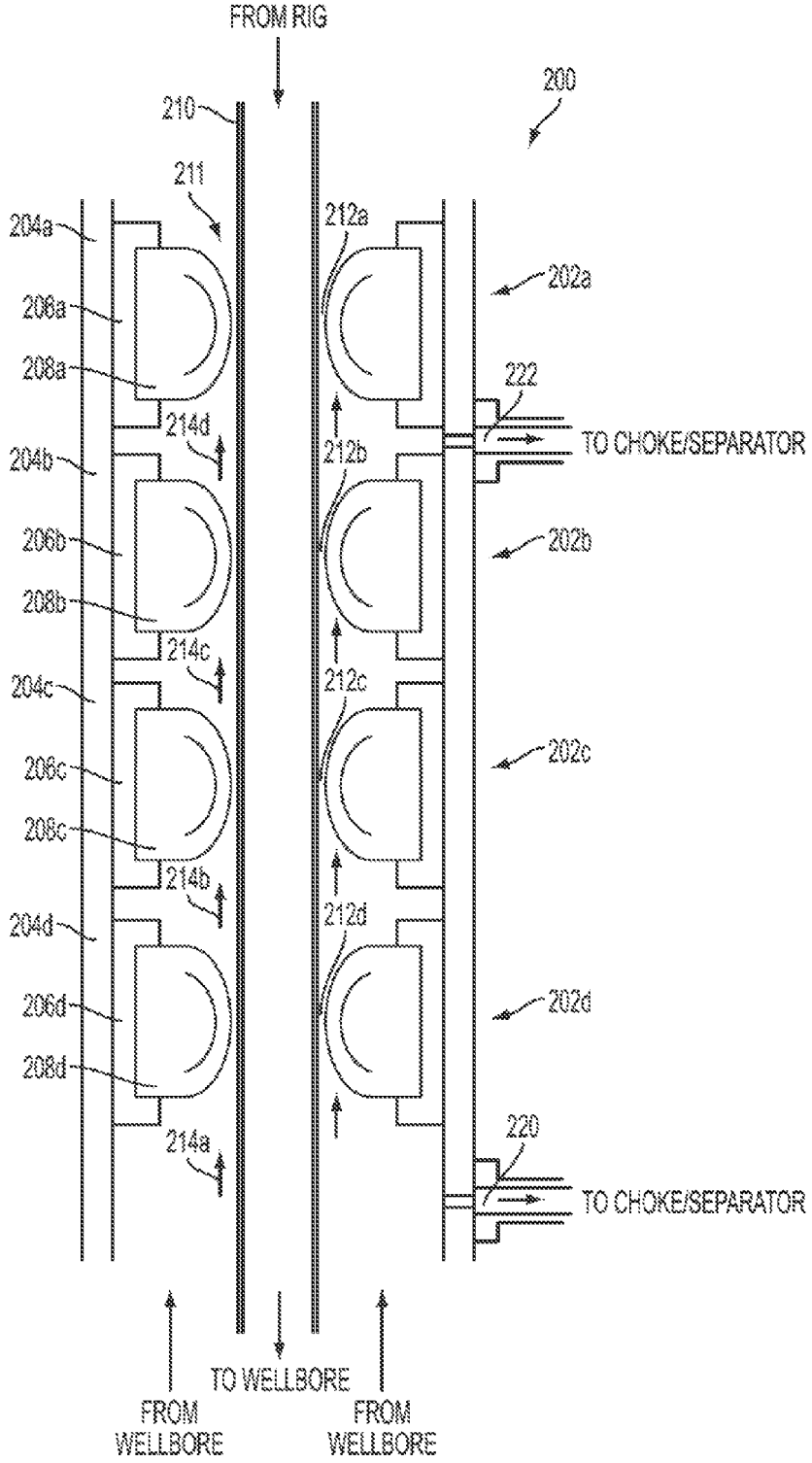
FIG. 2 is a cross-sectional view of a wellhead stack assembly according to one embodiment.

FIG. 2 depicts by cross section an example of the wellhead stack assembly 200. The wellhead stack assembly 200 includes multiple pressure restriction devices 202*a-d* that are staged. The pressure restriction devices 202*a-d* are staged in that the pressure restriction devices 202*a-d* are coupled in series in a flow path for fluid from a wellbore traveling from the wellbore in a direction toward a rig. The pressure restriction devices 202*a-d* can be RCDs or annular BOPs, but other types of equipment can be used.

The pressure restriction devices 202*a-d* include bodies 204*a-d*, bearing assemblies 206*a-d*, and seal elements 208*a-d*. The bearing assemblies 206*a-d* can couple the seal elements 208*a-d* to the bodies 204*a-d*. The seal elements 208*a-d* may be active seal elements in that the size, shape, and contact pressure of the seal elements can be controllably changed during operation. In some embodiments, the active seal elements are elastomeric. The seal elements 208*a-d* can be positioned about a drill pipe 210 in a passage 211 through the wellhead stack assembly 200 such that gaps 212*a-d* are formed between the drill pipe 210 and the seal elements 208*a-d*.

The gaps 212*b-d* can be sized for allowing fluid flow from the wellbore to leak to another pressure restriction device. As depicted by arrows 214*a-d* in an annulus between the drill pipe 210 and the pressure restriction devices 202*a-d*, fluid from the wellbore can flow toward the surface and leak from pressure restriction device 202*d* to pressure restriction device 202*c*, from pressure restriction device 202*c* to pressure restriction device 202*b*, and from pressure restriction device 202*b* to pressure restriction device 202*a* such that the pressure differential across each of the seal elements 208*a-d* is less than the total pressure differential across all of the seal elements 208*a-d*. Manipulating the size of the gap can change the amount of restriction that the flow experiences across a given seal element, and thus the pressure difference between one side of the seal element as compared to an opposite side. The size of the gap can be manipulated using contact pressure applied to the seal element. Reducing the contact pressure delivered to a seal element can result in a bigger gap, while increasing the contact pressure delivered to the seal element can result in a smaller gap. Contact pressure delivered to the seal element can be changed based on factors, such as an increase or decrease in the diameter of the drill pipe 210 or wear of the seal element to maintain the gap at the same size.

By way of example, pressure from fluid flow from the wellbore may be 3000 psi at arrow 214*a*, 2000 psi at arrow 214*b*, 1000 psi arrow 214*c*, and 10 psi at arrow 214*d*. Instead of a seal element experiencing a pressure differential of 3000 psi, each may experience a pressure differential of approximately 1000 psi. The amount of pressure drop across each of the seal element 208*a-d* can be controlled in part based on the size of the gaps 212*a-d*, which may be adjustable prior to using the wellhead stack assembly 200. For example, a larger gap can result in a smaller pressure differential across the seal element associated with the larger gap. The gaps 212*a-d* can reduce or prevent wear on the seal elements 208*a-d* from the drill pipe 210 in addition to reducing the differential pressure across each of the seal elements 208*a-d*.

The wellhead stack assembly 200 can also include flow paths 220, 222 to a choke or separator. Flow path 220 is between the pressure restriction device 202*d* and the wellbore, and can direct some of the fluid from the wellbore to a choke or a separator. Flow path 222 is between pressure restriction device 202*a* and pressure restriction device 202*b* for directing fluid from the wellbore at a lower pressure to a choke or a separator.

Figure 3:
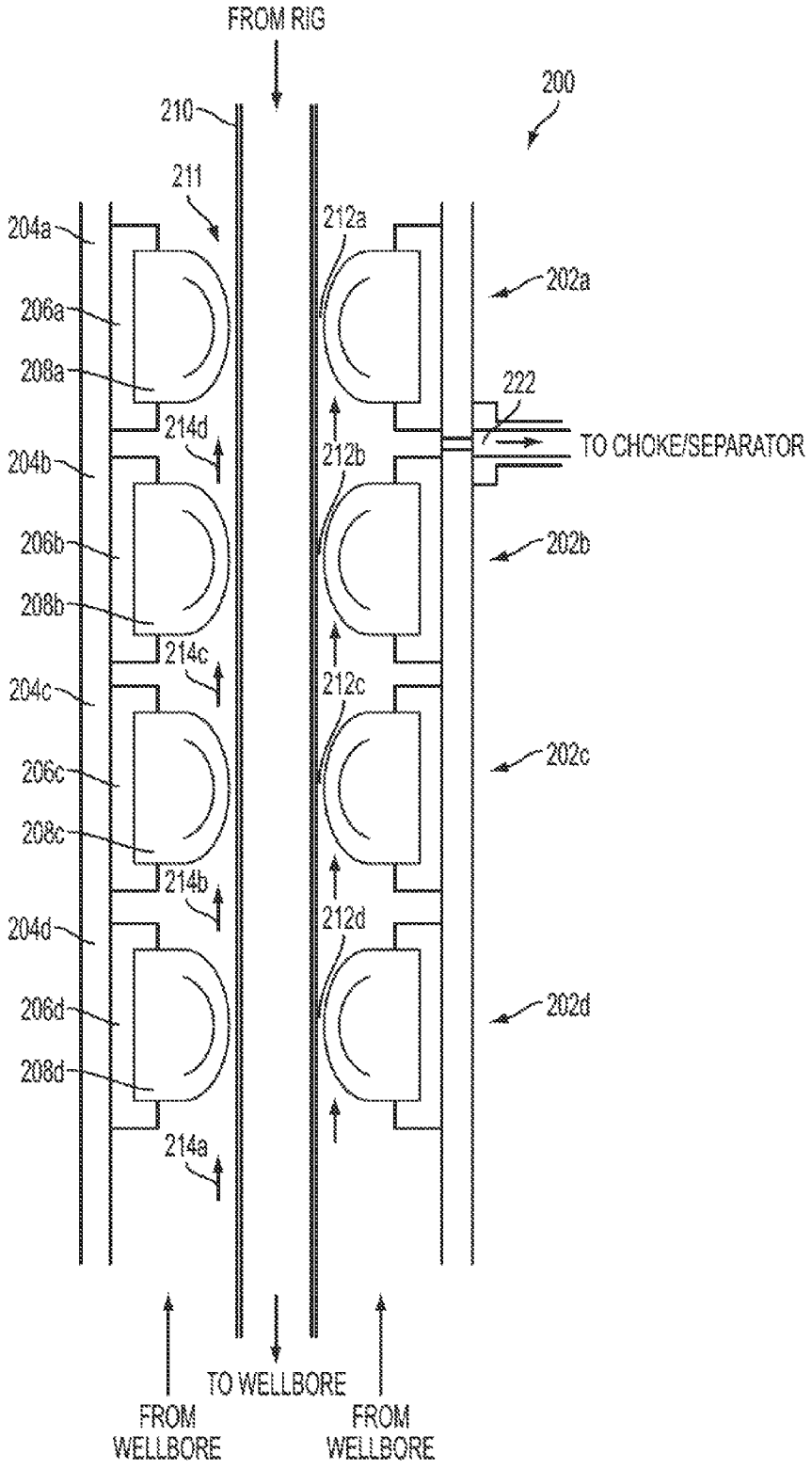
FIG. 3 is a cross-sectional view of a wellhead stack assembly according to another embodiment.

Using staged pressure restriction devices according to some embodiments can allow one or more of the flow paths 220, 222 to be eliminated. FIG. 3 depicts by cross-section another embodiment of the wellhead stack assembly 200 in which the flow path 220 is not included. The staged pressure restriction devices may decrease the pressure of the fluid from the wellbore prior to the fluid flowing through flow path 222 to a separator such that a choke subsystem is not needed for the wellhead stack assembly 200.

Figure 4:
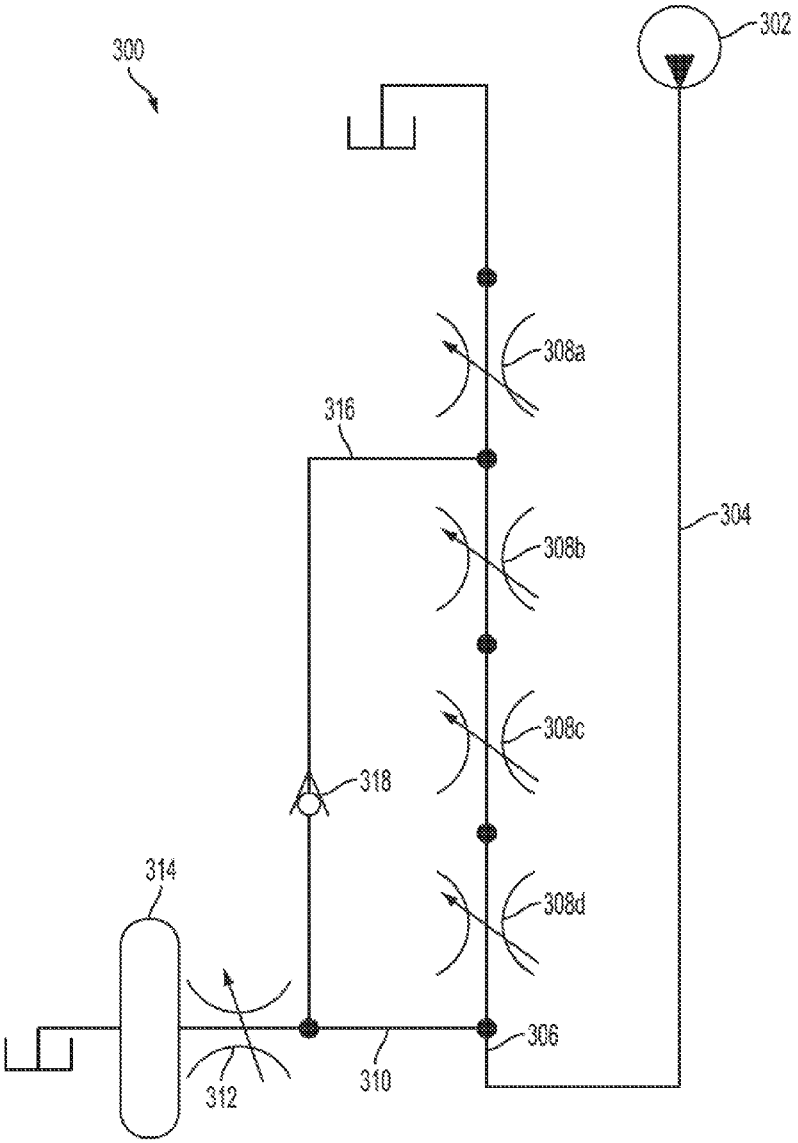
FIG. 4 is a schematic view of a well system with staged pressure restriction devices according to one embodiment.

FIG. 4 schematically depicts a well system 300 according to one embodiment. The well system 300 includes a rig pump 302 that can be located at or close to a rig for pumping drilling fluid through a drill pipe path 304 into a wellbore. The drilling fluid can flow from the wellbore toward the rig in a path 306 through an annulus toward staged pressure restriction devices, represented by adjustable flow restrictors 308*a-d*, with controllable gaps between active seal elements and a drill string. The adjustable flow restrictors 308*a-d* can be controlled such that there is a certain pressure drop for the fluid across each adjustable flow restrictor (i.e., pressure restriction device) and no one adjustable flow restrictor is required to hold all of the pressure from the fluid. Fluid flow to the rig can be prevented by seal elements of the pressure restriction devices.

A flow path 310 can be provided from the path 306 to allow some, but not all, of the fluid from the wellbore to flow to a choke, represented by an adjustable flow restrictor 312, and to a separator 314. Allowing some of the fluid to flow to the choke via the flow path 310 may further reduce pressure from the fluid applied to the adjustable flow restrictors 308*a-d*. Another flow path 316 can be provided from between the adjustable flow restrictor 308*a* and the adjustable flow restrictor 308*b* to the adjustable flow restrictor 312. Fluid flowing in the flow path 316 may be at a significantly reduced pressure because of pressure drops from the adjustable flow restrictors 308*a-d*. A one-way check valve 318 can be in the flow path 316 to prevent fluid in the flow path 310 from ingress into the flow path 316.

In some aspects, a wellhead stack assembly is provided for reducing a differential pressure across a given seal element of a pressure restriction device according to one or more of the following examples.

Example 1

A wellhead stack assembly includes pressure restriction devices that are fluidly coupled in series and staged such that each pressure restriction device is coupled to another pressure restriction device for cascading pressure differentials across the pressure restriction devices. Each pressure restriction device includes an active seal element positionable about a drill pipe to a control a gap between the drill pipe and the active seal element.

Example 2

The wellhead stack assembly of Example 1 can feature the pressure restriction devices including rotating control devices.

Example 3

The wellhead stack assembly of any of Examples 1 to 2 can feature the pressure restriction devices including annular blowout preventers.

Example 4

The wellhead stack assembly of any of Examples 1 to 3 can feature the active seal element being an elastomeric seal element.

Example 5

The wellhead stack assembly of any of Examples 1 to 4 can feature the gap of at least some of the pressure restriction devices being sized for allowing fluid flow from a wellbore to leak to another pressure restriction device.

Example 6

The wellhead stack assembly of any of Examples 1 to 5 can feature the gap being adjustable for providing adjustable fluid flow restriction.

Example 7

The wellhead stack assembly of any of Examples 1 to 6 can feature each pressure restriction device further comprising a body housing portion and a bearing assembly coupling the body housing portion to the active seal element.

Example 8

The wellhead stack assembly of any of Examples 1 to 7 can feature a flow path to a choke or a separator. The flow path is positioned between two of the pressure restriction devices that are closest to a surface of a wellbore than remaining pressure restriction devices.

Example 9

A wellhead stack assembly includes a first pressure restriction device and a second pressure restriction device. The first pressure restriction device includes a first active seal element. the second pressure restriction device includes a second active seal element and is coupled to the first pressure restriction device by a body housing. The first active seal element and the second active seal element form gaps between a passage for receiving a drill pipe and the first active seal element and the second active seal element for causing pressure drops for fluid flow from a wellbore across the first active seal element and the second active seal element.

Example 10

The wellhead stack assembly of Example 9 can feature each of the first active seal element and the second active seal element being separately adjustable for changing an amount of pressure drop across the respective first active seal element and the second active seal element.

Example 11

The wellhead stack assembly of any of Examples 9 to 10 can feature the first pressure restriction device and the second pressure restriction device being rotating control devices.

Example 12

The wellhead stack assembly of any of Examples 9 to 10 can feature the first pressure restriction device and the second pressure restriction device being annular blowout preventers.

Example 13

The wellhead stack assembly of any of Examples 9 to 12 can feature the first active seal element and the second active seal element being elastomeric seal elements.

Example 14

The wellhead stack assembly of any of Examples 9 to 13 can feature a gap formed by the second active seal element being sized for allowing fluid flow from the wellbore to leak to the first pressure restriction device.

Example 15

The wellhead stack assembly of any of Examples 9 to 14 can feature a flow path to a choke or a separator. The flow path is positioned between the first pressure restriction device and the second pressure restriction device.

Example 16

A wellhead stack assembly includes pressure restriction devices that are staged such that each pressure restriction device is coupled to another pressure restriction device for cascading pressure differentials of fluid from a wellbore across the pressure restriction devices. Each pressure restriction device includes an active seal element positionable about a drill pipe and being separately controllable for defining a gap between the drill pipe and the active seal element.

Example 17

The wellhead stack assembly of Example 16 can feature the gap of at least some of the pressure restriction devices being sized for allowing fluid flow from a wellbore to leak to another pressure restriction device.

Example 18

The wellhead stack assembly of any of Examples 16 to 17 can feature a flow path to a choke or a separator. The flow path is positioned between two of the pressure restriction devices that are closest to a surface of a wellbore than remaining pressure restriction devices.

Example 19

The wellhead stack assembly of any of Examples 16 to 18 can feature the pressure restriction devices including rotating control devices or annular blowout preventers.

Example 20

The wellhead stack assembly of any of Examples 16 to 19 can feature the active seal element being an elastomeric seal element.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A wellhead stack assembly, comprising:

a plurality of pressure restriction devices fluidly coupled in series, the pressure restriction devices being staged such that each pressure restriction device is coupled to an adjacent pressure restriction device for cascading pressure differentials across the plurality of pressure restriction devices, each pressure restriction device including an active seal element positionable about a drill pipe to control a gap between the drill pipe and the active seal element, wherein the gap of at least some of the plurality of pressure restriction devices is sized for allowing fluid flow from a wellbore to leak to an adjacent pressure restriction device.

2. The wellhead stack assembly of claim 1, wherein the plurality of pressure restriction devices include rotating control devices.

3. The wellhead stack assembly of claim 1, wherein the plurality of pressure restriction devices include annular blowout preventers.

4. The wellhead stack assembly of claim 1, wherein the active seal element is an elastomeric seal element.

5. The wellhead stack assembly of claim 1, wherein the gap is adjustable for providing adjustable fluid flow restriction.

6. The wellhead stack assembly of claim 1, wherein each pressure restriction device of the plurality of pressure restriction devices further comprises:

a body housing portion; and a bearing assembly coupling the body housing portion to the active seal element.

7. The wellhead stack assembly of claim 1, further comprising a flow path to a choke or a separator, the flow path being positioned between two of the plurality of pressure restriction devices that are closest to a surface of a wellbore than remaining pressure restriction devices of the plurality of pressure restriction devices.

8. A wellhead stack assembly, comprising:

a first pressure restriction device that includes a first active seal element; and a second pressure restriction device that includes a second active seal element and that is coupled to the first pressure restriction device by a body housing, wherein the first active seal element and the second active seal element form gaps between a passage for receiving a drill pipe and the first active seal element and the second active seal element for causing pressure drops for fluid flow from a wellbore across the first active seal element and the second active seal element, wherein a gap formed by the second active seal element is sized for allowing fluid flow from the wellbore to leak to the first pressure restriction device.

9. The wellhead stack assembly of claim 8, wherein each of the first active seal element and the second active seal element are separately adjustable for changing an amount of pressure drop across the respective first active seal element and the second active seal element.

10. The wellhead stack assembly of claim 8, wherein the first pressure restriction device and the second pressure restriction device are rotating control devices.

11. The wellhead stack assembly of claim 8, wherein the first pressure restriction device and the second pressure restriction device are annular blowout preventers.

12. The wellhead stack assembly of claim 8, wherein the first active seal element and the second active seal element are elastomeric seal elements.

13. The wellhead stack assembly of claim 8, further comprising a flow path to a choke or a separator, the flow path being positioned between the first pressure restriction device and the second pressure restriction device.

14. A wellhead stack assembly, comprising:

pressure restriction devices that are staged such that each pressure restriction device is coupled to another pressure restriction device for cascading pressure differentials of fluid from a wellbore across the pressure restriction devices, each pressure restriction device including an active seal element positionable about a drill pipe and being separately controllable for defining a gap between the drill pipe and the active seal element, wherein the gap of at least some of the pressure restriction devices is sized for allowing fluid flow from a wellbore to leak to another pressure restriction device.

15. The wellhead stack assembly of claim 14, further comprising a flow path to a choke or a separator, the flow path being positioned between two of the pressure restriction devices that are closest to a surface of a wellbore than remaining pressure restriction devices.

16. The wellhead stack assembly of claim 14, wherein the pressure restriction devices include rotating control devices or annular blowout preventers.

17. The wellhead stack assembly of claim 14, wherein the active seal element is an elastomeric seal element.

* * * * *